United States Patent [19]

James

[11] Patent Number: 4,554,039

[45] Date of Patent: Nov. 19, 1985

[54] WATERBED RAIL AND METHOD OF MAKING SAME

[75] Inventor: Max F. James, Tea, S. Dak.

[73] Assignee: Tea Industries, Inc., Tea, S. Dak.

[21] Appl. No.: 595,997

[22] Filed: Apr. 2, 1984

[51] Int. Cl.[4] ..... B29C 24/00

[52] U.S. Cl. ..... 156/213; 156/216; 428/122; 52/716

[58] Field of Search ..... 428/68, 71, 122; 248/345.1; 52/717, 716; 156/212, 213, 216

[56] References Cited

U.S. PATENT DOCUMENTS 1,589,517 6/1926 Desmarquoy ..... 428/122

2,774,410 12/1956 Davies ..... 156/216

3,513,050 5/1970 Samuels et al. ..... 156/212 X

*Primary Examiner*—Alexander S. Thomas

[57] ABSTRACT

A padded rail for a waterbed and the method of making it. The rail comprises a channel-shaped core portion adapted to fit over the side of the holder of the waterbed. The core is formed of extruded plastic and is covered with a foam padding and a fabric covering wrapped over the foam and into the channel shape. In its manufacture, the channel is either wrapped into a flat piece of foamed material or inserted into a groove in the foam material and the fabric is wrapped around and cemented into the inner part of the channel in the core.

2 Claims, 2 Drawing Figures

WATERBED RAIL AND METHOD OF MAKING SAME

BACKGROUND AND SUMMARY OF THE INVENTION

This invention pertains to padded rails for waterbeds and more particularly to a light weight, simply manufactured rail which can be produced in various lengths and with a minimum of manual labor.

Waterbeds as presently used comprise a mattress like device filled with water and supported by a shallow box like structure having an open top. Ordinarily the upper edge of the sides of the box is unprotected unless an auxiliary rail is provided.

Padded rails are now available to protect the upper edge. These rails are formed of an inverted U-shaped portion usually constructed of three strips of pressed wood or similar material nailed or otherwise fastened together to form the U-shape. Around this shape a foamed padding material is wrapped to cover these sides of the U-shape and then a fabric or leather material is wrapped around the padding and stapled to the U-shaped piece to complete the rail.

This mode of construction requires considerable labor in the formation of the core piece and in stapling the outer material to that core. Further, the core is relatively heavy, thereby increasing transportation costs and making the device more clumsy for handling by the owner of the bed.

By my invention, I provide a lighter weight, relatively strong rail and a less expensive method of building it.

FIGURES

DESCRIPTION

Figure 1:
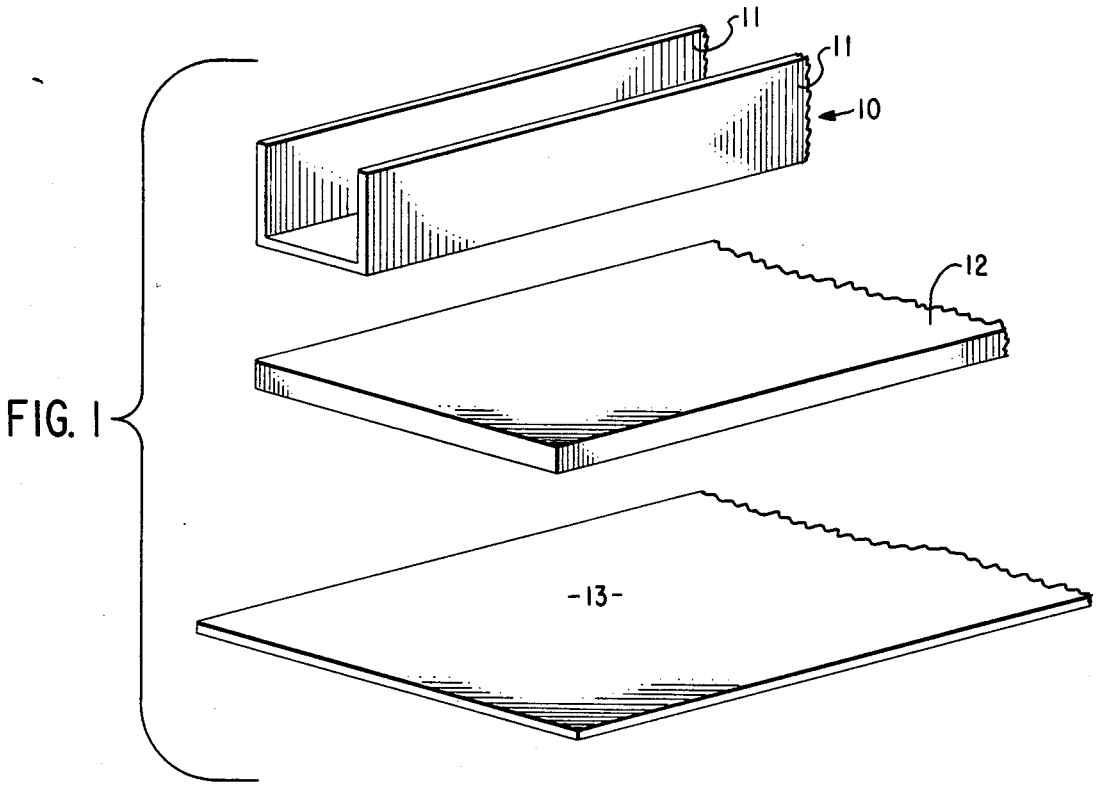
FIG. 1 is an exploded view of the parts of my rail ready to be assembled.
Figure 2:
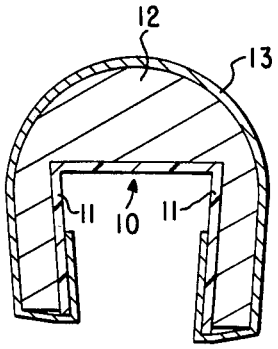
FIG. 2 is a transverse sectional view of the rail.

Briefly my invention comprises a novel padded rail for a waterbed including a light weight plastic core and a method of manufacture of such a rail.

More specifically and referring to the drawings, my rail includes a light weight, extruded plastic channel member 10. This channel member is adapted to fit over the edges of the box-like structure which forms the base for holding the waterbed mattress. The base is customarily constructed of boards usually of the same thickness regardless of the manufacturer, so that the spacing between the legs 11 of the channel member can be uniform for substantially all beds. This spacing is about 1/16th to 1/8th inch larger than the thickness of the boards which form the base. It is preferably slightly wider at the closed end than at the open end so that the channel will slip onto the side boards.

Around the three closed sides of the channel-shaped member 10 I place a foamed padding material 12. Because of lower costs, this material is usually flat and is bent around, but it may be formed to provide a fairly snug fit around the channel, and may be rounded on the surface away from the channel. Other shapes may be used as desired for the outer surface.

A covering 13 of fabric material—leatherette, plastic or leather or some similar material—is used to cover the padding 12 and to hold the entire matter together as will appear. This material is wrapped around the padding 12 as the padding is wrapped around the channel and is cut so that will overlap the edges of the legs 11 and extend within the channel 10.

It will be apparent that the rail can be made of any suitable length or can be made substantially continuous and cut later to an appropriate length. It may be preferable to use fixed lengths so that the covering can be pulled over the end of the padding to provide a closed end, but I also conceive of a possible use of mitered ends to provide side rails and head and foot end rails fitted together at mitered corners.

In assembling the rail according to my invention, the covering material 13 is cut to the proper width and is laid out flat. The padding 12 is then laid on the material so that the center of what will be the top of the rail is at the center of the material. The channel member is then placed on the padding in proper position, or may be inserted into the formed groove in the padding—if a groove is provided. Then the cover material is wrapped around the assembled pieces and is cemented to the interior of the legs 11 of the channel. I prefer to use a quick drying cement which is laid in a single bead on the inner surface of each leg of the channel, but I recognize that there are several types of cement which may be used to bond the material to the channel. I realize that other methods of bonding may also be used. For example, the cover material 13 may be held in place with a pressure sensitive tape. There may also be various types of electrical bonding which could be used.

This method of putting the rail together is quick, clean, and inexpensive. It is easy to provide a relatively smoother outer finish for the rail. Also, by lapping the material into the inner surface of the channel, I provide a somewhat resilient fit for the rail over the edge of the bed and one which does not scratch the bed because there are no staples, exposed wood or the like.

I claim as my invention:

1. The method of making a padded rail which comprises laying out a precut sheet of cover material, placing preformed padding onto said cover material, said padding being formed in channel shape with a rounded exterior, said placing being such that the centerline of said cover material is aligned with the portion of said padding which is to be the highest part of the finished product, placing a preformed channel member into the interior of the channel shape of the padding and drawing up the edges of said cover material around said padding and said channel member and fastening said edges to the interior of said channel member.

2. The method of claim 1 in which said channel member is an extruded material and said fastening is accomplished by cementing said cover material to the interior of said channel.

* * * * *